US006305499B1

(12) United States Patent
Jones et al.

(10) Patent No.: US 6,305,499 B1
(45) **Date of Patent: *Oct. 23, 2001**

(54) DRUM DRIVE ELEVATOR USING FLAT BELT

(75) Inventors: David W. Jones, Mentone (AU); Yuji Kanzaki, Kawasaki (JP); Tadaaki Nabetani, Inagi (JP); Toshimitsu Mori, Hadano (JP); Shusaku Shibasaki, Yashio (JP); Yasuhisa Shioda, Tokyo (JP); Hiroaki Tateno, Kawasaki (JP)

(73) Assignee: Otis Elevator Company, Farmington, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/566,517

(22) Filed: May 8, 2000

Related U.S. Application Data

(62) Division of application No. 09/163,676, filed on Sep. 30, 1998.

(51) Int. Cl.[7] ..... B66B 11/06

(52) U.S. Cl. ..... 187/261; 187/254; 187/262; 187/259; 187/266; 254/338

(58) Field of Search ..... 187/250, 251, 187/261, 252, 259, 262, 266; 254/338

(56) References Cited

U.S. PATENT DOCUMENTS

| | | | | |
|---|---|---|---|---|
| 364,863 | | 6/1887 | Schollian et al. | 187/261 |
| 384,864 | * | 6/1888 | O'Keefe | 187/261 X |
| 497,922 | | 5/1893 | Koeberlein | 187/262 |

(List continued on next page.)

FOREIGN PATENT DOCUMENTS

| | | | | |
|---|---|---|---|---|
| 1 032 496 | | 6/1958 | (DE) . | |
| 2 206 035 | | 2/1972 | (DE) . | |
| 2 209 455 | | 2/1972 | (DE) . | |
| 2209455 | * | 9/1973 | (DE) | 187/261 |
| 2 333 120 | | 1/1975 | (DE) . | |
| 2 523 345 | | 12/1975 | (DE) . | |
| 296 15 921 U1 | | 4/1997 | (DE) . | |
| 0 606 875 A1 | | 1/1994 | (EP) | B66B/11/04 |
| 0 779 233 A2 | | 6/1994 | (EP) | B66B/11/04 |
| 0 784 030 A2 | | 6/1994 | (EP) | B66B/11/00 |
| 0 688 735 A2 | | 6/1995 | (EP) | B66B/11/04 |
| 0 710 618 A2 | | 10/1995 | (EP) | B66B/11/00 |
| 0 749 930 A2 | | 6/1996 | (EP) | B66B/11/00 |
| 0 749 931 A2 | | 6/1996 | (EP) | B66B/11/08 |
| 2 640 604 | | 12/1988 | (FR) . | |

(List continued on next page.)

OTHER PUBLICATIONS

"Elevator Mechanical Design, Principles and Concepts", by Lubomir Janovsky, Ellis Horwood Limited (1987).

Article "Electrical Lifts—A Practical Treatis on their Construction Operation and Maintenance" Aug. 1942, George Newnes Limited, London AP002103802, Paragraph 2.

Derwent Publications Ltd., London, XP002103803, Abstract of SU 1 518 277 A.

Elevator Mechanical Design Principles and Concepts, Hanover Fair: Another New Idea from Contitech—Lifting Belts for Elevators.

*Primary Examiner*—Eileen D. Lillis
*Assistant Examiner*—Thuy V. Tran

(57) ABSTRACT

An elevator system (10) includes an elevator car (18) supported for vertical movement on a belt (16) having an end fixed to the hoistway (26) and the other end wound about a drum (32) of a drum drive (12). When the belt (16) is wound or unwound about the drum (32), the elevator car (18) is raised or lowered, respectively.

4 Claims, 4 Drawing Sheets

U.S. PATENT DOCUMENTS

| | | | | |
|---|---|---|---|---|
| 708,626 | | 9/1902 | Dexter . | |
| 1,071,309 | | 8/1913 | Goggin . | |
| 3,101,130 | | 8/1963 | Bianca . | |
| 3,910,383 | | 10/1975 | Friedl | 187/16 |
| 4,570,753 | | 2/1986 | Ohta et al. . | |
| 4,949,815 | | 8/1990 | Pavoz | 187/20 |
| 5,429,211 | | 7/1995 | Aulanko et al. | 187/254 |
| 5,435,417 | | 7/1995 | Hakala | 187/404 |
| 5,469,937 | | 11/1995 | Hakala et al. | 187/266 |
| 5,490,578 | | 2/1996 | Aulanko et al. | 187/254 |
| 5,899,301 | | 5/1999 | Aulanko et al. | 187/254 |
| 6,109,596 | * | 8/2000 | Garnier | 254/337 X |

FOREIGN PATENT DOCUMENTS

| | | | | |
|---|---|---|---|---|
| 1 401 197 | | 7/1975 | (GB) . | |
| 2 138 397 B | | 11/1985 | (GB) . | |
| 2 201 657 | | 8/1990 | (GB) . | |
| 2267073 | * | 11/1993 | (GB) | 254/278 |
| 1-242386 | | 9/1989 | (JP) . | |
| 630185A | | 10/1978 | (SU) | 187/261 |
| WO 96/09978 | | 4/1996 | (WO) | B66B/7/06 |
| F197/00/824 | | 7/1998 | (WO) | B65G/17/36 |
| F197/00823 | | 7/1998 | (WO) | B65G/17/34 |

* cited by examiner

DRUM DRIVE ELEVATOR USING FLAT BELT

This is a division of copending application Ser. No. 09/163,676 filed on Sep. 30, 1998, the contents of which is incorporated herein by reference.

TECHNICAL FIELD

The present invention relates to elevator systems and, more particularly, to a drum drive elevator system that requires minimal installation and operation space and that eliminates the potential of inadvertently driving past the top terminal.

BACKGROUND OF THE INVENTION

Known drum drive elevator systems typically involve "cotton reel" type drum and lifting rope arrangements where the rope is wound onto the drum with successive turns such that each length of rope is placed adjacent to the prior length to form a single layer of wound rope. Such systems are usually limited to single layer rope winding because of safety and rope life considerations. In situations where the elevator car must travel over a large rise, the length of the drum required to accommodate single layer rope winding becomes impractical. Because of the length of the drum in such instances, large variations in the rope path occur as the rope is wound along the drum. This may cause difficulty in the placement of guidance sheaves and may result in changing direction of forces imposed on the elevator car thereby affecting ride quality.

In typical elevator systems, lifting force on an elevator car is delivered from a sheave located above the car. Without additional means of control, the lifting force could continue to be delivered until the elevator car impacts either the ceiling of the hoistway or the sheave. Thus, there exists the potential in conventional elevator systems having the drive sheave or drum located overheard that the elevator car may be accidentally driven through the top terminal. Special precautions are ordinarily required to ensure that drive force is disabled when the elevator car moves beyond the top terminal level. In traction elevator systems, for example, a deceleration zone and safety equipment such as a rope brake are required, adding cost and space consumption.

Conventional drum and traction elevator systems usually require a large machine room to accommodate the overhead machine and components, including safety features. It is desirable to eliminate the need for a large machine room and its associated costs and building structure requirements.

OBJECTS AND SUMMARY OF THE INVENTION

It is an object of the present invention to provide a drum elevator system that requires minimal machine room space. It is a further object to provide a drum elevator system that has inherent safety features to eliminate the potential of driving through the top terminal. These and other inherent objects are achieved by the invention as described below.

The present invention elevator system utilizes a drum and rope system that allows multiple layers of rope winding around the drum. The arrangement eliminates the problems described above associated with rope path variation and ride quality, while increasing the practical limit for rise height. The present invention elevator system also ensures that the lifting force on the elevator car is reduced to zero at a short distance past the upper terminal level, thereby eliminating the over-rise problem described above. This loss of lifting force is inherently controlled by the sizing and spatial arrangement of the drum, car sheaves, a diverter sheave and the fixed hitch point of the belt. In the present invention the vertical positions of the drum and the fixed hitch point define the limit of the highest achievable vertical position of the elevator car. This feature eliminates the need for speed limiting or other safety features.

The present invention elevator system requires only a small machine room that can be located on the top terminal floor, avoiding the need for a separate structure and special building requirements. There is no requirement for hoistway space to accommodate a counterweight, as is required with conventional traction systems.

In another embodiment of the present invention, an elevator system utilizes a single drum drive positioned at the bottom of the hoistway, or in the hoistway pit, and is adapted to simultaneously wind two traction belts. Each traction belt is attached to and supports one side of the elevator car. One end of each belt is attached to the elevator car, and the other end of each belt is attached to the drive drum for selective winding to retract or release belt length, thereby controlling vertical movement of the elevator car. The positioning of the drum drive in the pit eliminates the need for a machine room or external structure for mounting the drive, while allowing sufficient space for the double-wound drum when the elevator car is in a raised position.

These and other advantages are apparent from the description provided below.

DESCRIPTION OF THE PREFERRED EMBODIMENT

Figure 1:
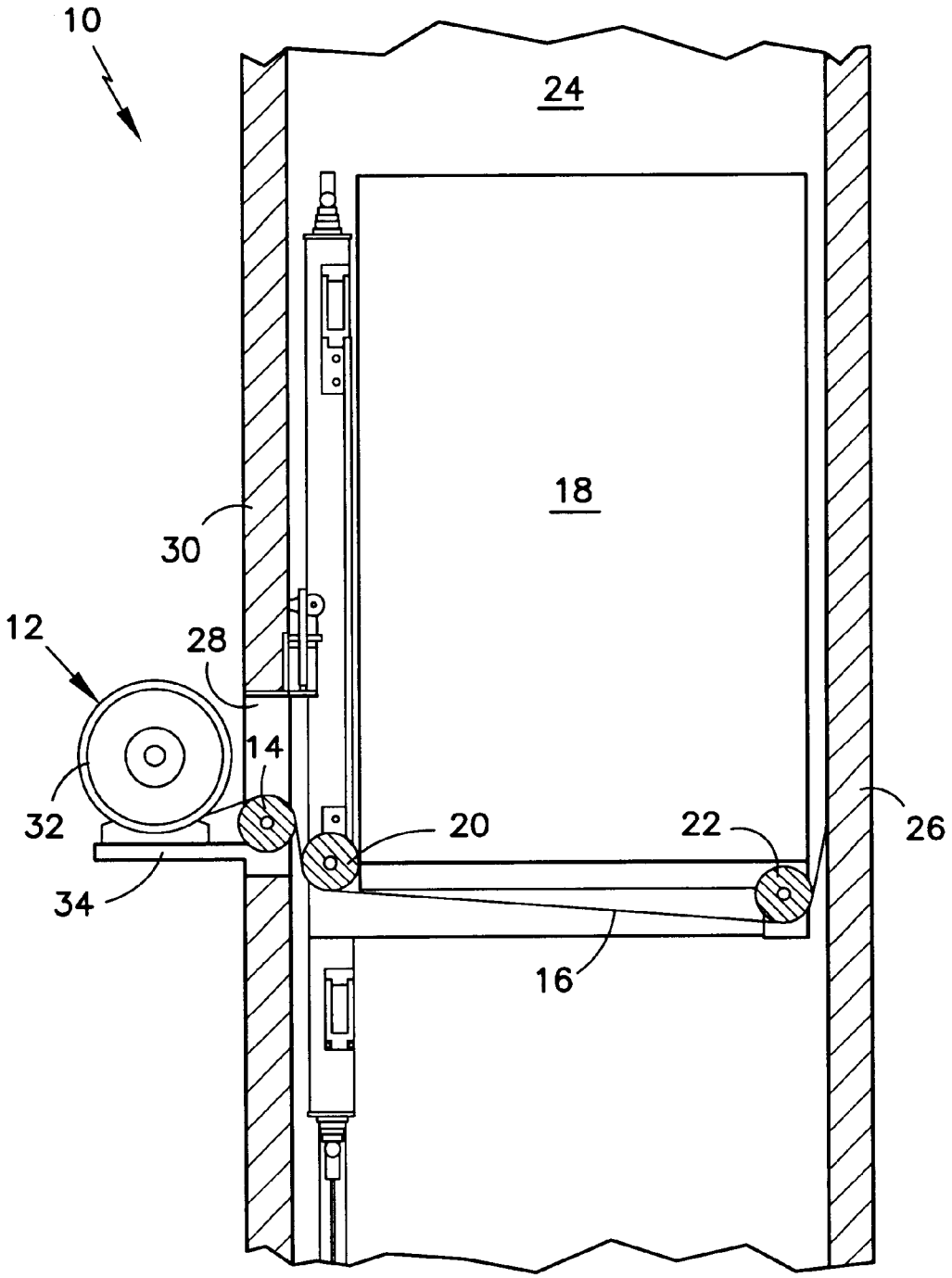
FIG. 1 is a partial, schematic, side cross-sectional view of an elevator system according to the present invention, showing the elevator car near a top position.

Referring to FIG. 1, the present invention elevator system (10) includes a drum drive assembly (12), a diverter sheave (14), a belt (16), and an elevator car (18) having two underside sheaves (20, 22). The elevator car (18) and associated sheaves (20, 22) are positioned for vertical movement within a hoistway (24). The belt (16) is fixed at one end to a first hoistway wall (26). The other end of the belt (16) passes through an opening (28) in a second hoistway wall (30) and engages a drum (32) component of the drum drive (12) in a wrap-around fashion. The diverter sheave (14) is mounted in the second hoistway wall (30).

The drum drive assembly (12) is mounted on a base (34) that is fixed relative to the hoistway. The assembly (12) includes a conventional motor (not shown) and a drum (32) adapted to selectively rotate in either direction. The belt (16), preferably a flat belt or flat rope, is wound successively around the drum (32). The terms "flat ropes" or "flat belts" as used herein refer to ropes or belts having an aspect ratio greater than one, where the aspect ratio is defined as the ratio of the rope or belt width to thickness. The belt or rope should be sufficiently thin to enable successive winding around the drum so that a rope or belt of sufficient length to enable a desired range of lift height can be used. Conventional controls are used to activate and direct power to the motor which, in turn, imparts torque to cause the drum (32) to rotate thereby winding or unwinding the belt (16).

In operation, the elevator car (18) can be lowered from the raised position shown in FIG. 1 by activating the motor to turn the drum (32) counterclockwise to unwind the belt (16) from the drum (32). As the belt (16) is let out over the diverter sheave (14) and underneath the two car-mounted sheaves (20, 22), the force of gravity acting on the elevator car (18) forces the car (18) to move downward while being supported by the belt (16). Conventional guide or track means (not shown) are used to guide the car movement as it descends or ascends. The first end of the belt (16) remains fixed to the first hoistway wall (26). When the desired car (18) position is reached, the, drum (32) is stopped. In order to raise the elevator car (18), the same procedure is followed with the drum (32) being caused to rotate in the opposite direction.

A safety feature of the present invention for preventing the elevator car (18) from overrunning or from rising higher than the upper terminal is dependent upon the sizing and positioning of the fixed end of the belt (16) and the drum (32). While the preferred embodiment is directed to a drum drive, it is possible to implement the presently described features in a system using a traction drive.

Figure 2:
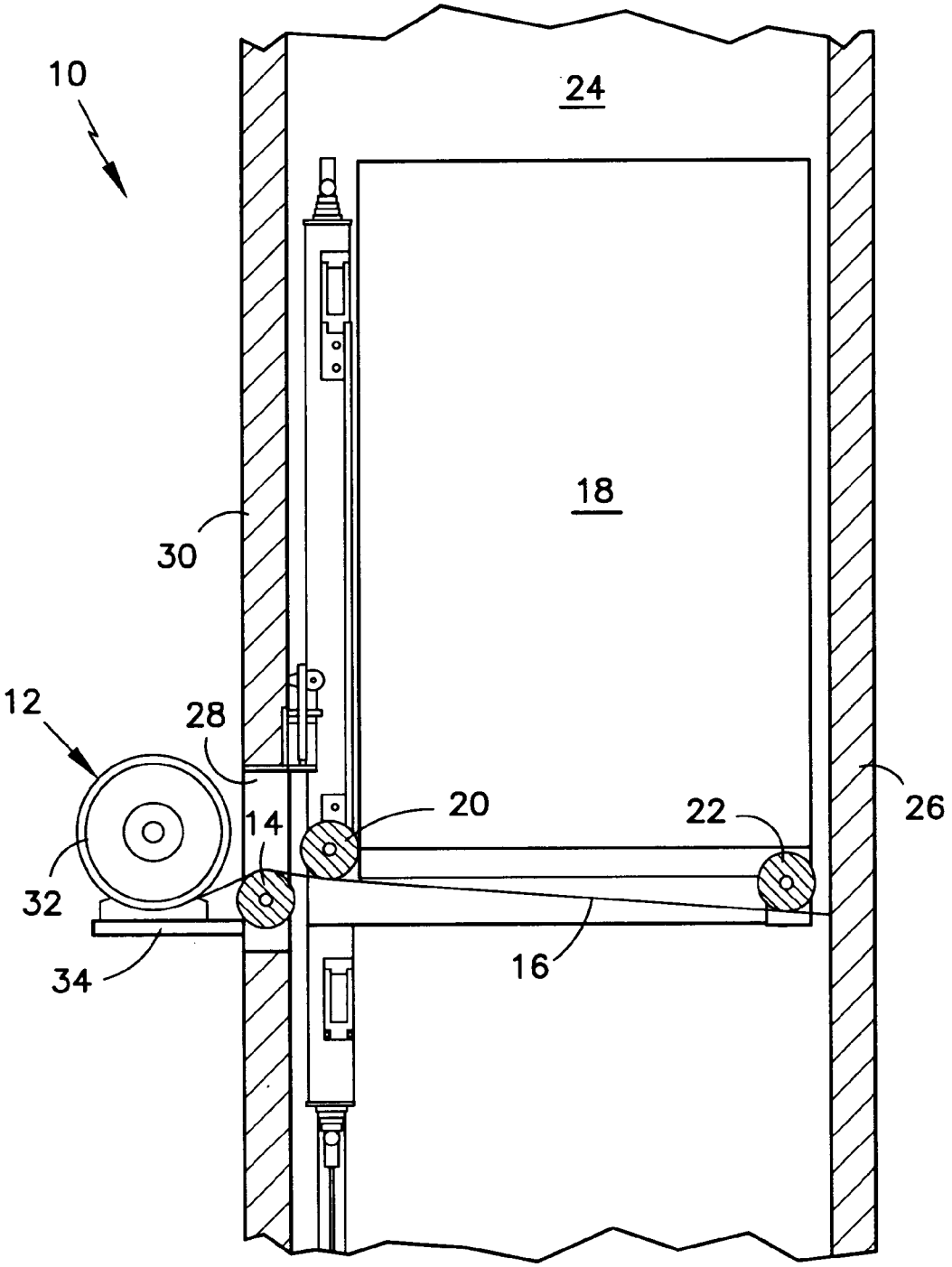
FIG. 2 is a view as shown in FIG. 1, in which an elevator car is at the absolute top position.

Referring to FIG. 2, with the drum (32) placed at the top floor level and the fixed end of the belt (16) located at approximately top floor level, the elevator car (18) can be driven only up to a point where the bottoms of the car sheaves (20, 22) are level with a plane connecting the top of the diverter sheave (14) and the fixed point of the belt (16). Even with infinite tension on the belt (16) the elevator car (18) cannot travel above this point. Thus, the diameter and placement of the diverter sheave (14), the diameter and placement of the car sheaves (20, 22), and the position of the fixed belt (16) point limit the vertically upward travel of the elevator car (18).

The car sheaves (20, 22) are offset with respect to vertical height for the reasons explained below. As the elevator car (18) travels upward, the center of the first car sheave (20) passes the center of the diverter sheave (14). As a result, the tension necessary to maintain upward travel increases, as the load of the car (18) formerly supported by the first car sheave (20) is transferred to the second car sheave (22).

As the center of the first car sheave (20) passes the center of the diverter sheave (14), and the tension necessary to maintain upward travel of the car (18) begins to increase, the net lifting force will be reduced in a cosine like manner, reducing from one hundred percent of the belt tension when the center of the first car sheave (20) is level with the center of the diverter sheave (14), to zero when the bottom of the first car sheave (20) is level with the top of the diverter sheave (14). Movement of the second car sheave (22) past the fixed hitch point of the belt (16) has a similar effect on net lifting force from the second car sheave (22), but the net force reduction occurs over a movement of only half the sheave (22) diameter.

Thus, the rate of deceleration of the elevator car (18) is controlled by the diameter and placement of the diverter sheave (14), the diameter and placement of the car sheaves (20, 22), and the placement of the fixed hitch point of the belt (16).

The arrangement of components of the present invention elevator system (10) imposes minimal requirements on the building structure. All vertical forces are supported by the hoistway (24). Horizontal forces from belt tension are supported by the top terminal floor. No special machine or hitch beams are required. The total mass that needs to be transported to, installed in and supported by the building structure is less than half of that associated with a conventional traction elevator system. Only minimal top overrun clearance is necessary, and no overhead machine room is needed. The present invention elevator system can be used in a smaller hoistway space than a traction system that requires room for a counterweight.

Figure 3:
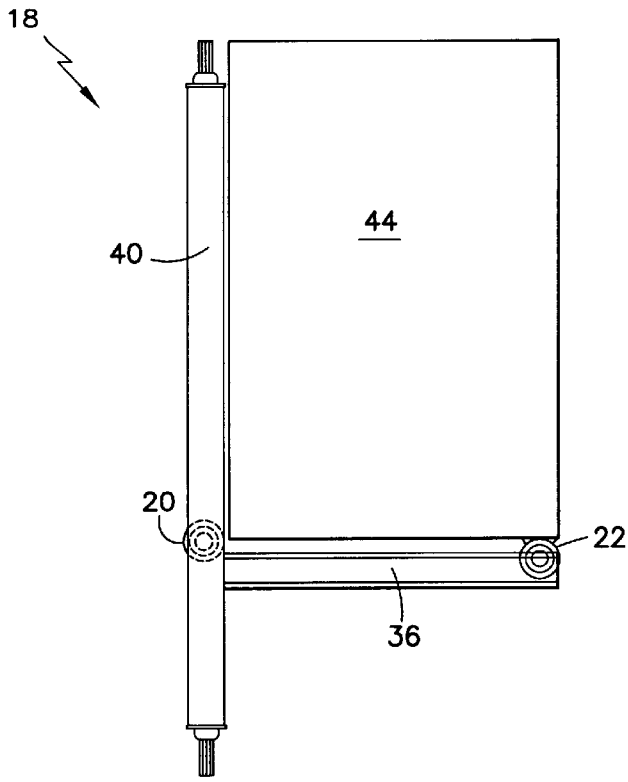
FIG. 3 is a partial, schematic side view of an elevator car assembly according to the present invention.
Figure 4:
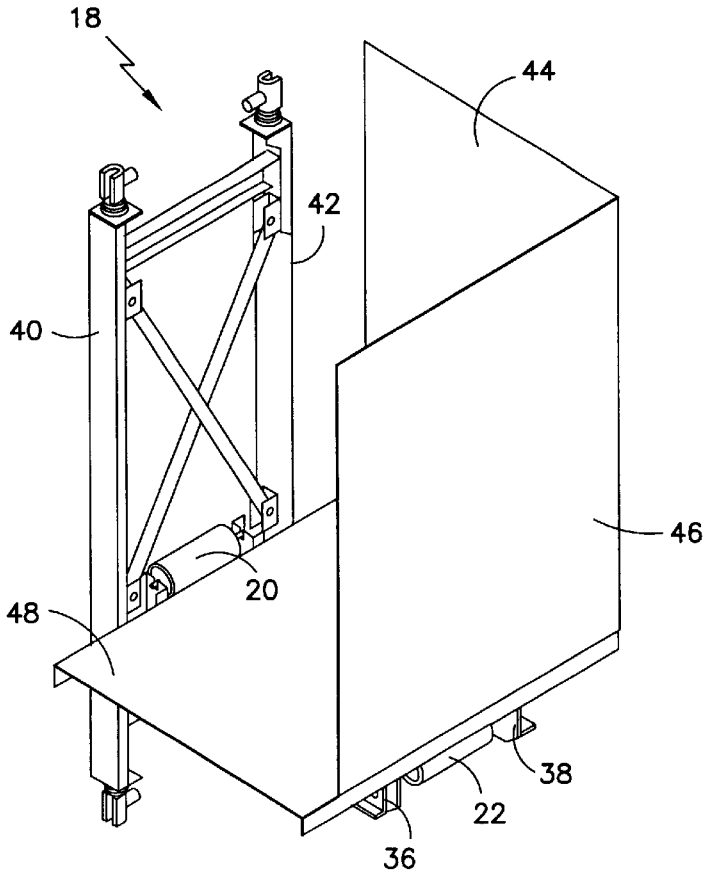
FIG. 4 is a partial, schematic perspective view of an elevator car assembly according to FIG. 3.

The construction of the car (18) and its sheave components used with the preferred embodiment as described herein is described with respect to FIGS. 3 and 4. In the side view of FIG. 4 there is disclosed a pair of cantilever supports (36, 38) that support the car (18) from underneath at the car floor (48) and that extend from a pair of vertical frame members (40, 42). Not all of the car walls (44, 46) are shown, nor the roof, in order to allow illustration of other components. The car (18) may be made with a single entrance or with double entrances. The vertical frame members (40, 42) may be provided with conventional safety and guide components (not shown).

The vertical frame members (40, 42) are limited in height so as to not extend above the top of the car (18). The car walls (44, 46), floor (48), and roof are formed from a thin structural material, such as an aluminum sandwich panel, to enable them to be self-supporting. Such construction enables minimum wall thickness with maximum floor area. The drum drive assembly (12) is located on the top floor at the side of the hoistway (24) or in a small machine room (not shown) at the same level as the top floor. In order to ensure that vertical loads are passed directly to the hoistway wall (30), the diverter sheave (14) is positioned in an opening (28) in the wall (30) enabling the diverter sheave (14) to extend slightly into the hoistway (24). The diverter sheave (14) is positioned as closely as possible to the floor level to minimize overrun distance.

The hitch point for the end of the belt (16) is on the wall (26) opposite the drum drive assembly (12). The hitch point is located vertically so that, when the elevator car (18) is at the top floor level, a substantially straight line can be drawn through points connecting the top of the diverter sheave (14), the bottom of each car sheave (20, 22), and the hitch point. This is the maximum vertical position attainable by the car (18).

Because the car (18) is lifted essentially through its center of mass, there are only small loads placed on guides, guide rails, or the car structure except for loads caused by use of safety equipment that may be utilized.

The drum drive assembly (12) is preferably a single unit including a motor, a gearbox, a brake, a drum, a diverter pulley, a drive, a controller and a governor.

While the preferred embodiment utilizes a diverter sheave (14) and two car sheaves (20, 22), it is possible to implement a system within the scope of the present invention in which no diverter sheave is used and in which a different number of car sheaves such as, for example, one sheave is used or in which no car sheaves are used. The position of the car sheave or sheaves on the elevator car is not necessarily limited to the bottom of the elevator car and may be, for example, on the top of the elevator car.

Figure 5:
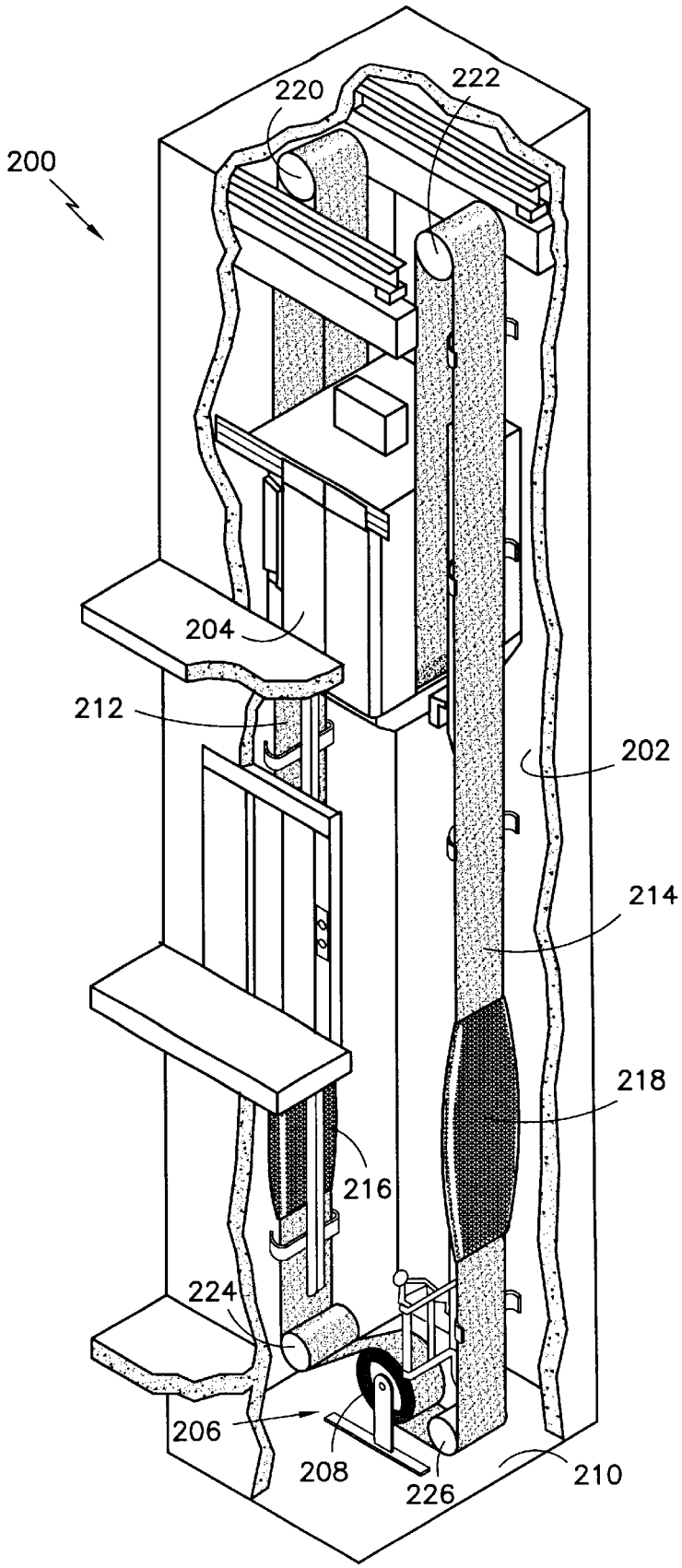
FIG. 5 is a partial, schematic perspective view of an elevator system of according to a second embodiment of the present invention.

A second embodiment of the present invention is directed to the elevator system (200) shown in FIG. 5. The system (200) includes a hoistway (202), an elevator car (204), a drive assembly (206) including a drive drum (208) located at the bottom (210) or in the pit of the hoistway (202), a pair of drive belts (212, 214), a pair of counterweights (216, 218) attached to the drive belts (212, 214), a pair of suspension sheaves (220, 222), and two sets of diverter pulleys (224, 226). The drive drum (208) receives both belts (212, 214) simultaneously so that they wrap and unwrap over each other. By sharing a single drive drum (208), the two belts (212, 214) are easily synchronized and the space required for the drive assembly (206) is minimal. By positioning the drum (208) below in the hoistway (202), there is sufficient space to accommodate the increased diameter of the drum (208) when the belts (212, 214) are fully wound and the elevator car (204) is in the fully raised position. The diverter pulleys (224, 226) maintain the necessary positioning of the belts (212, 214) to enable simultaneous winding around the same drum (208).

While the preferred embodiment of the present invention has been herein described, it is acknowledged that variation of the aforedescribed embodiment may be undertaken without departing from the scope of what is presently claimed.

I claim:

1. An elevator system comprising:

an elevator car traveling within a hoistway;

a drive assembly including a drive drum disposed in the hoistway at a location below the travel path of the car; and a pair of drive belts, each having one end fixed to said elevator car and each having the other end fixed to said drive drum, whereby said elevator car is suspended by said belts and is selectively moved by rotating said drive drum such that said pair of drive belts wrap over each other on said drive drum, and wherein each of said belts extends from said drive drum in a direction opposite of the other of said belts.

2. The elevator system according to claim 1, further including a pair of diverter pulleys, each of said diverter pulleys engaged with one of said pair of drive belts.

3. The elevator system according to claim 2, further including a pair of counterweights, and wherein each of said belts extends outward from said drive drum and upward from the pit to one of said counterweights, wherein each of said belts then extends upward from said counterweight to one of said diverter pulleys, and wherein each of said belts extends downward to the elevator car.

4. The elevator system according to claim 1, further including a pair of counterweights, each of said counterweights engaged with one of said pair of drive belts.

* * * * *